US008307835B2

(12) United States Patent
King

(10) Patent No.: US 8,307,835 B2
(45) Date of Patent: Nov. 13, 2012

(54) DAISY CHAIN HAIR CLASPS FOR CREATING RINGLETS AND WAVES

(76) Inventor: Pamela King, Tucker, GA (US)

( * ) Notice: Subject to any disclaimer, the term of this patent is extended or adjusted under 35 U.S.C. 154(b) by 0 days.

(21) Appl. No.: 12/951,013

(22) Filed: Nov. 20, 2010

(65) Prior Publication Data

US 2011/0120490 A1 May 26, 2011

Related U.S. Application Data

(60) Provisional application No. 61/281,990, filed on Nov. 25, 2009.

(51) Int. Cl.
*A45D 7/00* (2006.01)
*A45D 8/20* (2006.01)
*A45D 8/00* (2006.01)

(52) U.S. Cl. ..... 132/200; 132/277; 132/276

(58) Field of Classification Search ..... 132/277, 132/278, 279, 273, 275, 276; 24/489, 543, 24/487

See application file for complete search history.

(56) References Cited

U.S. PATENT DOCUMENTS 1,135,745 A * 4/1915 Wenzlick ..... 132/279
1,373,619 A * 4/1921 Kohn ..... 24/331
2,496,810 A * 2/1950 Nerrie ..... 434/160
5,172,534 A * 12/1992 Milner et al. ..... 52/632
6,098,636 A * 8/2000 Curtiss et al. ..... 132/277
6,102,049 A * 8/2000 Chang ..... 132/273
6,681,779 B2 * 1/2004 Stachowski ..... 132/279
D493,013 S * 7/2004 Stachowski ..... D28/42
7,258,123 B2 * 8/2007 Silva ..... 132/277
7,581,547 B2 * 9/2009 Pena ..... 132/275
2009/0032045 A1 * 2/2009 Fitzpatrick ..... 132/200

OTHER PUBLICATIONS

White Sands Products, 2009, [web page] Printed from Internet on Jan. 13, 2011 <URL: http://www.whitesandsproducts.com/Products/Default.aspx?cid=6>.

* cited by examiner

*Primary Examiner* — Robyn Doan

(57) ABSTRACT

Three or more hairstyling clasps can be used to create a hairstyle effect on a person's hair. Each clasp has first and second generally strip-like portions. A lock of the hair is twisted and positioned between the first and second portions of a first clasp, and the clasp is closed to secure the first lock. A second lock of hair can be similarly twisted and positioned between the first and second portions of a second clasp and the clasp closed to secure the second lock. The two clasps are then fastened together by fastening a portion of the outside surface of the first portion of the first clasp to a portion of the outside surface of the second portion of the second clasp. Additional locks of hair can be twisted and secured within additional clasps in the same manner, and the additional clasps can be fastened to the other clasps in a daisy-chain-like manner.

6 Claims, 6 Drawing Sheets

DAISY CHAIN HAIR CLASPS FOR CREATING RINGLETS AND WAVES

CROSS-REFERENCE TO RELATED APPLICATION

The benefit of the filing date of U.S. Provisional Patent Application Ser. No. 61/281,990, filed Nov. 25, 2009, entitled "Daisy Chain Hair Clasps for Creating Ringlets and Waves," is hereby claimed, and the specification thereof is incorporated herein in its entirety by this reference.

BACKGROUND

The tousled hair look has become quite popular in the last several years. Women with wavy, bushy, and/or frizzy hair have long struggled to take control of their locks and turn them into manageable curls, ringlets, and waves.

Ringlets can be created by twisting locks of wet hair and holding them in place while the hair is dried using a blow dryer. Ringlets can also be created by twisting locks of hair using a curling iron. Traditional curlers in various incarnations have been used to hold twisted locks of hair in place during drying. However, curlers are not well adapted for this purpose. Also, heating tools such as curling irons and blow dryers require a significant time investment and typically damage the hair, further contributing to the frizz that women want to eliminate.

SUMMARY

Embodiments of the invention relate to a kit comprising three or more clasps and a method for using clasps of the kit to create a hairstyle effect on a person's hair. Each clasp has a first portion and a second portion. The first portion has a generally strip-like shape, an inside surface, an outside surface, a first end and a second end. The second portion similarly has a generally strip-like shape, an inside surface, an outside surface, a first end and a second end. In accordance with an exemplary embodiment of the method, a lock of the hair is twisted and positioned between the first and second portions of a first clasp at some point between the ends of the portions. The lock is then secured between the first and second portions of the first clasp by fastening at least a portion of the inside surface of the first portion of the first clasp to at least a portion of the inside surface of the second portion of the first clasp. For example, in an embodiment in which portions of the inside surfaces include hook-and-loop fastener material, hook material of the inside surface of the first portion of the clasp can engage loop material of the inside surface of the second portion of the clasp. A second lock of hair can be similarly twisted and positioned between the first and second portions of a second clasp at some point between the ends of the portions. The lock is then secured between the first and second portions of the second clasp in the same manner described above with regard to the first clasp. The two clasps are then fastened together by fastening a portion of the outside surface of the first portion of the first clasp to a portion of the outside surface of the second portion of the second clasp. Additional locks of hair can be twisted and secured within additional clasps in the same manner, and the additional clasps can be fastened to the other clasps in a daisy-chain-like manner. The hair can be dried or otherwise treated in any suitable manner while the clasps are in place. When the clasps are removed, the locks of hair remain to some extent in a twisted state, providing a desirable hairstyle effect.

Other structures, methods, features, and advantages of the invention will be or become apparent to one with skill in the art upon examination of the following figures and detailed description.

BRIEF DESCRIPTION OF THE FIGURES

The invention can be better understood with reference to the following figures. The components within the figures are not necessarily to scale, emphasis instead being placed upon clearly illustrating the principles of the invention. Moreover, in the figures, like reference numerals designate corresponding parts throughout the different views.

DETAILED DESCRIPTION

Figure 1:
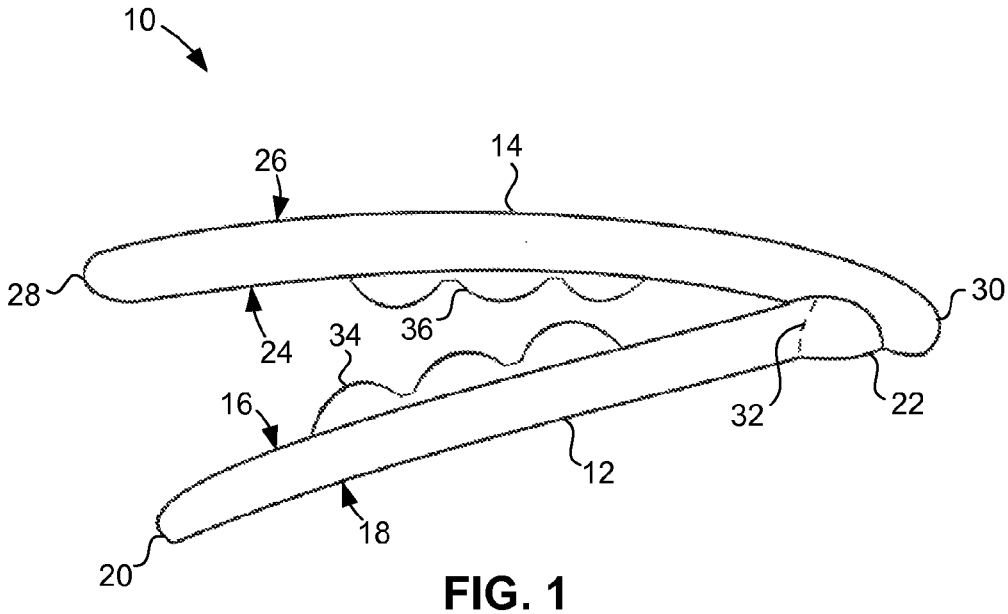
FIG. 1 is a side elevation view of a hair clasp, showing the clasp in an open position, in accordance with an exemplary embodiment of the invention.

As illustrated in FIGS. 1-4, in an illustrative or exemplary embodiment of the invention, a clasp 10 comprises a first portion 12 and a second portion 14. Clasp 10 is shown in an open position in FIG. 1. First portion 12 has a generally elongated, strip-like shape, an inside surface 16, an outside surface 18, a first end 20, and a second end 22. First portion 12 can be made of a flexible material. An example of a suitable material is a hook-and-loop fastening system material that is commercially available in the form of strips and rolls and has hook material on one side or surface and loop material on the other or opposing side or surface. Such hook-and-loop fastener material is widely commercially available under the brand name VELCRO®. Thus, although not shown in detail for purposes of clarity, inside surface 16 of first portion 12 can comprise hook material and outside surface 18 of first portion 12 can comprise loop material. However, in other embodiments the inside surface can comprise loop material, and the outside surface can comprise hook material. In the exemplary embodiment, second portion 14 has a structure that is similar to that of first portion 12. Accordingly, second portion 14 has an elongated, strip-like shape, an inside surface 24, an outside surface 26, a first end 28, and a second end 30. Inside surface 24 of second portion 14 can comprise loop material and outside surface 26 of second portion 14 can comprise hook material. In different embodiments, the first and second portions can have correspondingly different widths, lengths, thicknesses or other characteristics to accommodate different hair types or for other purposes. Although in the exemplary embodiment first and second portions 12 and 14 are made of the above-described flexible, fabric-like hook-and-loop material, in other embodiments the first and second portions can be made of any other suitable flexible or rigid material or materials.

A seam 32 connects second end 22 of first portion 12 to second end 30 of second portion 14. That is, first and second portions 12 and 14 can be sewn or otherwise fastened to each other at their respective second ends 22 and 30. Although in the exemplary embodiment first and second portions 12 and 14 are attached by seam 32, in other embodiments the first and second portions can be attached or otherwise fastened in any other suitable manner. For example, mating portions of a snap or similar fastener can be included in the first and second portions. In still other embodiments, no seam or other separate fastener may be included. Rather, the hook-and-loop fastening system or other fastening system provided by the inside surfaces can also serve to fasten the second ends of the first and second portions together. Also, in some embodiments, the first and second portions may be part of a unitary structure and thus seamless or otherwise continuous. Still other fastening systems can be included in still other embodiments, such as fastening systems based upon magnets or fastening systems based upon re-adherable adhesives of the type used in, for example, POST-IT® brand paper products. Also, although in the exemplary embodiment the hook-and-loop fastening system is attached to or otherwise integral with the first and second portions, in other embodiments the fastening system can be removable, such as a removable clip or band, and only coupled to the clasp when it is desired to fasten or hold the first and second portions together. Furthermore, the term "clasp" is used herein only for purposes of convenience, to refer to the overall device. The term "clasp" is not intended to imply any specific structure, such as a structure having portions that are hinged or otherwise movable with respect to one another.

Figure 2:
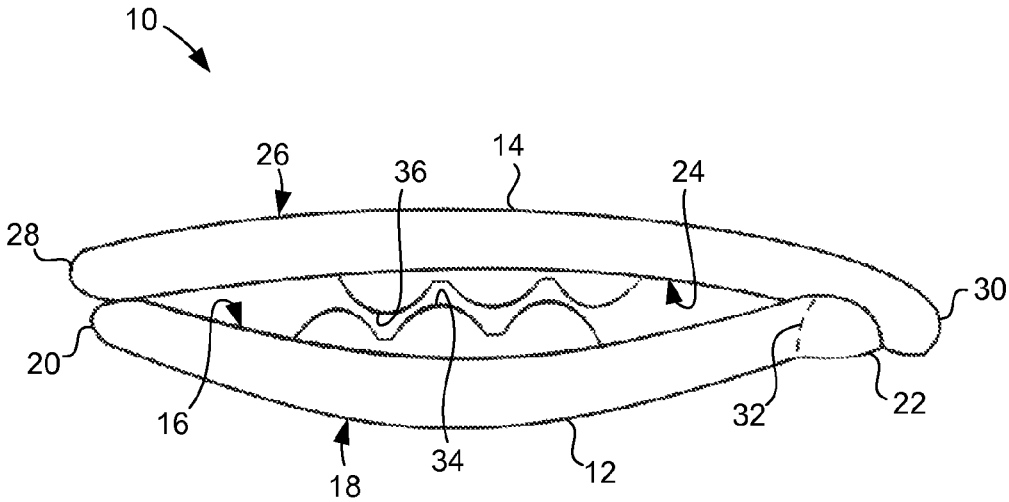
FIG. 2 is a side elevation view similar to FIG. 1, showing the clasp in a closed position.

As illustrated in FIG. 2, in the exemplary embodiment clasp 10 can be closed by fastening one or more portions of first portion 12 to one or more portions of second portion 14. In the exemplary embodiment, seam 32 serves as a hinge, such that first and section portions 12 and 14 can be moved in a hinge-like manner with respect to one another. Thus, to close clasp 10, a person can move one or both of first ends 20 and 28 toward each other until the respective inside surfaces 16 and 24 of portions 12 and 14 contact each other. In contact with each other, the hook material of inside surface 16 of first portion 12 engages the loop material of inside surface 24 of second portion 14, thereby fastening first and second portions 12 and 14 together at their respective first ends 20 and 28. It should be noted that although in the exemplary embodiment first ends 20 and 28 are fastened together by the hook-and-loop fastening system and second ends 22 and 30 are fastened together by seam 32, in other embodiments both ends can be fastened together in the same manner or a similar manner.

A first grip 34 is attached to inside surface 16 of first portion 12. A second grip 36 is attached to inside surface 24 of second portion 14. As described below, grips 34 and 36 help to hold a lock of hair in place. Accordingly, grips 34 and 36 can comprise a high-friction material, such as a rubberized or elastomeric material. An example of such a material is commercially available in the form of sheets for lining kitchen shelves and drawers, such as the product sold under the brand name CON-TACT GRIP LINER® by Kittrich Corp. of La Mirada, Calif. Such shelf lining material has a soft, cushioned rubber-like feel and a waffle or rippled texture (see FIG. 4), which are characteristics useful for holding a lock of hair in place. Nevertheless, such material is only one example of a suitable material, and in other embodiments of the invention any other suitable material can be used. It should be noted that in some embodiments of the invention, no grips need be included, such as in embodiments in which the material that defines the inside surfaces of the first and second portions is itself sufficiently frictional or otherwise sufficient to inhibit the lock of hair from pulling out of the clasp.

Figure 3:
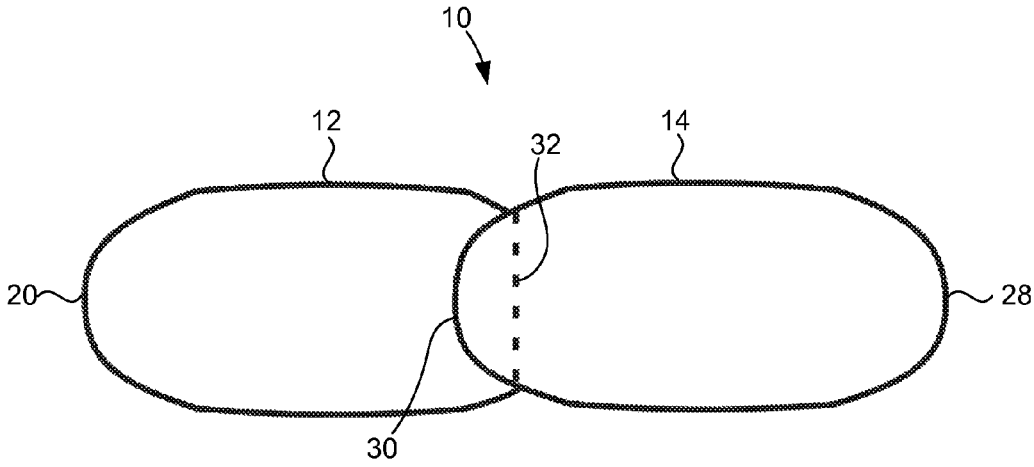
FIG. 3 is a plan view of the clasp of FIGS. 1-2, showing the outside surfaces of the clasp.
Figure 4:
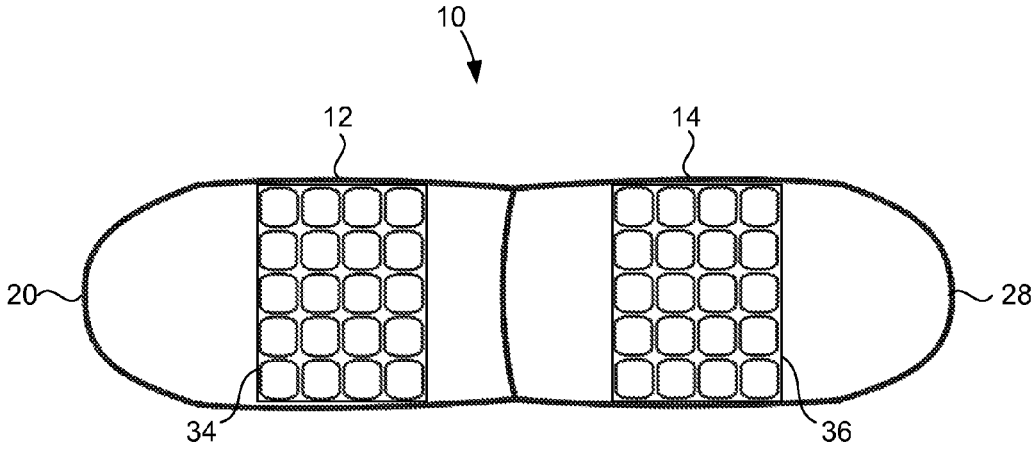
FIG. 4 is a plan view of the clasp of FIGS. 1-2, showing the inside surfaces of the clasp.

Clasp 10, when used as described below, is essentially only used in the open position shown in FIG. 1 and the closed position shown in FIG. 2. Nevertheless, clasp 10 is also shown in FIGS. 3-4 in positions in which first and second portions are spread apart, so that details of its construction can be better understood. Also, although not shown for purposes of clarity, inside and outside surfaces 16 and 18 of first portion 12 can have a color or other identifying feature that is distinct from the color or other identifying feature of inside and outside surfaces 24 and 26 of second portion 14. For example, inside and outside surfaces 16 and 18 of first portion 12 can be red, and inside and outside surfaces 24 and 26 of second portion 14 can be blue. The differing colors or other identifying features of portions 12 and 14 can be useful for the purpose described below or for other purposes.

Figure 5:
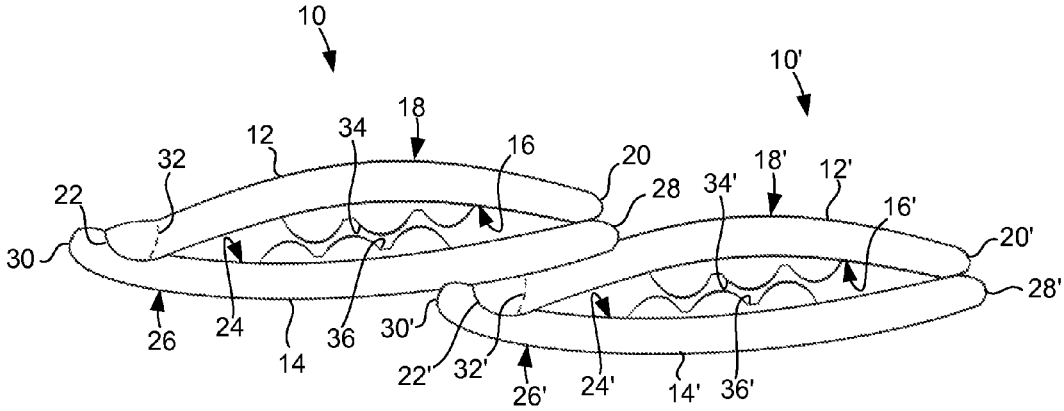
FIG. 5 is a side elevation view, showing two of the clasps of FIGS. 1-4 fastened together.

Clasp 10 can be provided in the form of a kit comprising, in one embodiment, two or more clasps 10 or, in an alternative embodiment, three or more clasps 10. As illustrated in FIG. 5, a first clasp 10 and a second clasp 10' can be fastened to each other by engaging the hook material of outside surface 26 of first clasp 10 with the loop material of the outside surface 18' of second clasp 10'. As described below, two, three, or more clasps 10 can be fastened to each other in a daisy-chain manner. Although the hook-and-loop fastening system is used in the exemplary embodiment to fasten multiple clasps 10 to each other in such a daisy-chain manner, in embodiments in which the fastening system comprises something other than a hook-and-loop fastening system the attendant elements or portions of such other fastening systems are used to fasten successive clasps to each other. Also, although in the exemplary embodiment a hook-and-loop fastening system is used to hold clasp 10 closed around the lock of hair as well as to interconnect multiple clasps 10, in other embodiments the fastening system that holds a clasp closed can be of a different type from the fastening system that interconnects the clasps.

Figure 6:
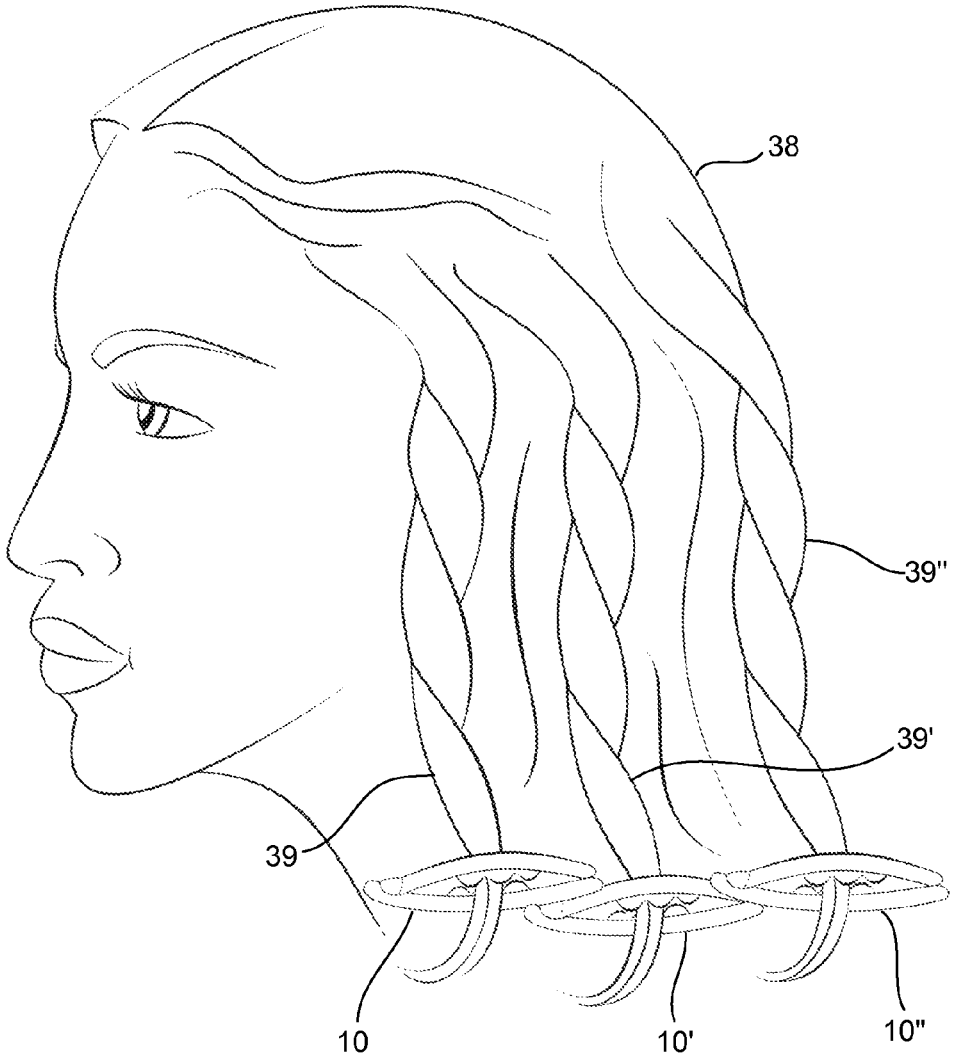
FIG. 6 is a side elevation view, showing three of the clasps of FIGS. 1-4 with locks of hair secured therein, in accordance with an exemplary method of using the clasps.
Figure 7:
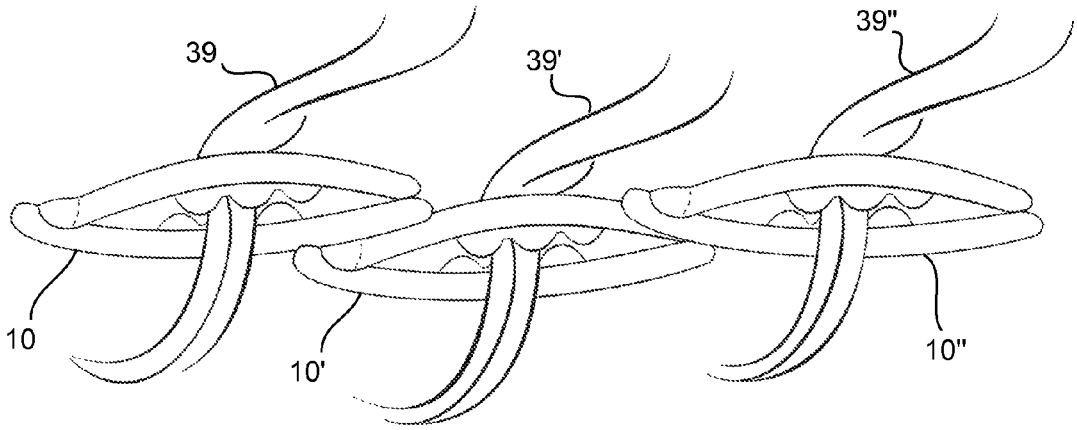
FIG. 7 is an enlarged view of a portion of FIG. 6, showing the locks of hair secured within the clasps.

As illustrated in FIGS. 6-7, to use the kit of clasps 10 to create a hairstyle effect on a person's ("subject's") hair 38, a person such as a hairstylist (or the subject herself) can lift a lock 39 of the subject's hair 38 from the scalp and twist lock 39 one or more times. Although as few as a single twist may be sufficient for purposes of an exemplary embodiment of the invention, it may be desirable to twist lock 39 many times so as to create a helical or spiraling series of twists extending from the scalp to the end of the lock. Lock 39 can be of any size that will fit within clasp 10, such as approximately one to three inches in diameter. The person then opens first clasp 10 to the open position shown in FIG. 1. The person then places lock 39 across the open clasp 10. Or, stated another way, clasp 10 is placed around lock 39. Lock 39 can be positioned, for example, approximately mid-way between the ends of clasp 10 so that lock 39 is positioned between the opposing grips 34 and 36. The person then closes clasp 10 to the closed position shown in FIG. 2, thereby securing lock 39 inside clasp 10 between first and second portions 12 and 14 and between first and second grips 34 and 36.

The person then repeats the steps above with a second lock 39'. Accordingly, the person lifts second lock 39' from the scalp, twists lock 39' one or more times, and places lock 39' in an open second clasp 10'. The person then closes the second clasp 10', thereby securing second lock 39' inside second clasp 10' in the same manner as first lock 39 was secured inside first clasp 10. The person then fastens second clasp 10' to first clasp 10 by engaging the hook material of outside surface 26 of first clasp 10 with the loop material of the outside surface 18' of second clasp 10' (see FIG. 5). In an embodiment in which outside surface 26 of first clasp 10 is a different color or otherwise readily visually distinguishable from outside surface 18' of second clasp 10', the person can readily distinguish the two outside surfaces that are to be fastened together.

The person can repeat the steps above with a third lock 39" and third clasp 10". Accordingly, the person lifts third lock 39" from the scalp, twists the lock one or more times, and places third lock 39" in the open third clasp 10". The person then closes third clasp 10", thereby securing third lock 39" inside third clasp 10" in the same manner as first and second locks 39 and 39' were respectively secured inside first and second clasps 10 and 10'. The person then fastens third clasp 10" to second clasp 10' by engaging the loop material of outside surface 18' of second clasp 10 with the hook material of the outside surface 26" of third clasp 10". In this manner, three or more clasps 10, 10', 10", etc., fastened to each other in a daisy-chain manner can respectively secure three or more twisted locks 39, 39', 39", etc., of hair. The mutually connected clasps 10 inhibit any of the locks that are retained therein from untwisting. Note that although in the above-described step third clasp 10" is fastened to second clasp 10' by engaging the loop material of outside surface 18' of second clasp 10 with the hook material of the outside surface 26" of third clasp 10", third clasp 10" can alternatively be fastened to second clasp 10' by engaging the hook material of outside surface 26' of second clasp 10 with the loop material of the outside surface 18" of third clasp 10".

Figure 8:
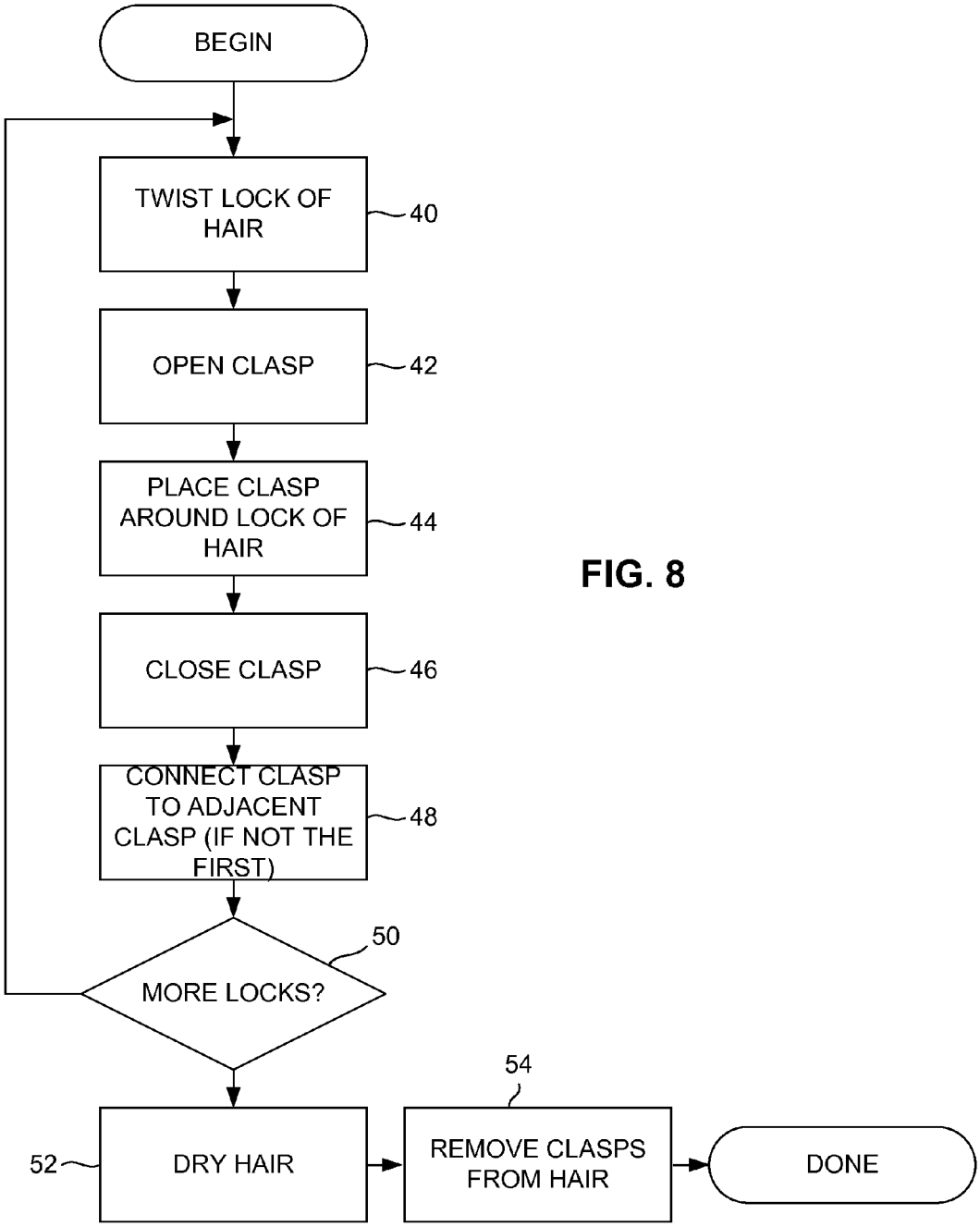
FIG. 8 is a flow diagram, illustrating the exemplary method of using the clasps.

The flow diagram of FIG. 8 summarizes the above-described method for creating a hairstyle effect on a person's hair. As indicated by block 40, a lock of the hair is twisted. As indicated by block 42, a clasp 10 is opened. As indicated by block 44, the clasp 10 is placed around the lock of hair. As indicated by block 46, the clasp 10 is closed around the lock of hair, thereby securing the lock of hair within the clasp 10. As indicated by block 48, the clasp is then fastened to another clasp if another clasp has previously been placed on another lock of hair. If, as indicated by block 50, more locks of hair are to be prepared in this manner, the procedure indicated by blocks 40-48 is repeated with another lock. If no more locks of hair are to be prepared, the locks of hair retained within the various clasps 10 can be subjected to further treatment or, alternatively, the clasps 10 can be removed from the hair.

Such further treatment can include drying the hair, as indicated by block 52, either with the aid of a blow dryer or through letting the hair dry naturally, in an instance in which the person's hair is wetted prior to the above-described method. Wetting the hair before attaching clasps 10 and then drying the hair while clasps 10 are in place may promote formation of a desired hairstyle effect. However, such wetting and drying of the hair are not required steps. Similarly, a hairstyling gel or other preparation can be applied to the hair prior to the above-described method, though it is not required. Regardless of whether the hair is dried, clasps 10 remain on the hair for some period of time, which can be as little as a few minutes or as much as several hours, depending upon the desired effect. Nevertheless, clasps 10 can be removed from the hair (i.e., by opening each clasp 10 and slipping it off the lock of hair) at any desired time, such as when it is believed that a desired hairstyling effect has been achieved. Removing clasps 10, as indicated by block 54, comprises opening clasps 10 by unfastening them in a manner that is the reverse of the above-described manner in which they are fastened, and slipping them off of the locks of hair. In view of the descriptions in this patent document, persons skilled in the field to which the invention relates will readily appreciate how factors such as whether water or another preparation is applied to the hair, how the hair is dried, and the length of time that clasps 10 remain on the hair can result in different hairstyling effects. Similarly, although an exemplary method of use of clasps 10 has been described, in view of this description, persons skilled in the field to which the invention relates will readily appreciate that the method or similar methods can be combined with other, conventional hairstyling methods to achieve various hairstyling effects.

While various embodiments of the invention have been described, it will be apparent to those of ordinary skill in the art that many more embodiments and implementations are possible that are within the scope of this invention. Accordingly, the invention is not to be restricted except in light of the following claims.

What is claimed is:

1. A method for creating a hairstyle effect on a person's hair using a plurality of clasps, each clasp of the plurality of clasps comprising a first portion and a second portion, the first portion having a generally strip-like shape, a first end and a second end, the second portion having a generally strip-like shape, a first end and a second end, the first portion having an inside surface and an outside surface, the second portion having an inside surface and an outside surface, the method comprising:

twisting a first lock of the hair;

positioning the first lock of hair between the first and second portions of a first clasp of the plurality of clasps, the lock of hair positioned between the first and second ends of the first portion of the first clasp and between the first and second ends of the second portion of the first clasp;

fastening at least a portion of the inside surface of the first portion of the first clasp to at least a portion of the inside surface of the second portion of the first clasp to secure the lock between the first and second portions of the first clasp;

twisting a second lock of the hair;

positioning the second lock of hair between the first and second portions of a second clasp of the plurality of clasps, the lock of hair positioned between the first and second ends of the first portion of the second clasp and between the first and second ends of the second portion of the second clasp;

fastening at least a portion of the inside surface of the first portion of the second clasp to at least a portion of the inside surface of the second portion of the second clasp to secure the lock between the first and second portions of the second clasp; and fastening a portion of one of the outside surfaces of the first clasp to a portion of one of the outside surfaces of the second clasp.

2. The method claimed in claim 1, further comprising:

twisting a third lock of the hair;

positioning the third lock of hair between the first and second portions of a third clasp of the plurality of clasps, the lock of hair positioned between the first and second ends of the first portion of the third clasp and between the first and second ends of the second portion of third second clasp;

fastening at least a portion of the inside surface of the first portion of the third clasp to at least a portion of the inside surface of the second portion of the third clasp to secure the lock between the first and second portions of the third clasp; and fastening a portion of one of the outside surfaces of the third clasp to a portion of one of the outside surfaces of the second clasp.

3. The method claimed in claim 1, wherein:

the inside surface of the first portion of each clasp comprises hook material of a hook-and-loop fastening system;

the inside surface of the second portion of each clasp comprises loop material of the hook-and-loop fastening system; and each of the steps of fastening at least a portion of the inside surface of the first portion of a clasp to at least a portion of the inside surface of the second portion of the comprises engaging the hook material of the inside surface of the first portion of the clasp with the loop material of the inside surface of the second portion of the clasp.

4. The method claimed in claim 1, wherein:

the outside surface of the first portion of each clasp comprises loop material of a hook-and-loop fastening system;

the outside surface of the second portion of each clasp comprises hook material of the hook-and-loop fastening system; and each of the steps of fastening a portion of one of the outside surfaces of one clasp to a portion of one of the outside surfaces of another clasp comprises engaging the hook material of one of the outside surfaces of the one clasp to the loop material of one of the outside surfaces of the another clasp.

5. The method claimed in claim 1, wherein:

the inside surface of the first portion each clasp of the plurality of clasps includes a first grip;

the inside surface of the second portion of each clasp of the plurality of clasps includes a second grip; and the step of securing the lock between the first and second portions of the first clasp further comprises securing the lock between the first grip and the second grip.

6. The method claimed in claim 1, wherein:

the second end of the first portion of each clasp is hingedly connected to the second end of the second portion of the clasp;

the step of positioning the first lock of hair between the first and second portions of a first clasp of the plurality of clasps comprises opening the clasp by hingedly moving at least one of the first end of the first portion and the first end of the second portion away from the other of the first end of the first portion and the first end of the second portion; and the step of securing the lock between the first and second portions of a clasp by fastening at least a portion of the inside surface of the first portion of the clasp to at least a portion of the inside surface of the clasp comprises closing the clasp by hingedly moving at least one of the first end of the first portion and the first end of the second portion toward the other of the first end of the first portion and the first end of the second portion, and fastening the first end of the inside surface of the first portion to the first end of the inside surface of the second portion.

* * * * *